US007175335B2

(12) United States Patent
Furukawa

(10) Patent No.: US 7,175,335 B2
(45) Date of Patent: Feb. 13, 2007

(54) EMULSION PRODUCING APPARATUS

(75) Inventor: Hideo Furukawa, Oyama (JP)

(73) Assignee: Komatsu Ltd., Tokyo (JP)

( * ) Notice: Subject to any disclaimer, the term of this patent is extended or adjusted under 35 U.S.C. 154(b) by 532 days.

(21) Appl. No.: 09/988,407

(22) Filed: Nov. 19, 2001

(65) Prior Publication Data

US 2002/0060950 A1 May 23, 2002

(30) Foreign Application Priority Data

Nov. 22, 2000 (JP) ..... 2000-356053

(51) Int. Cl.
*B01F 5/06* (2006.01)

(52) U.S. Cl. ..... 366/155.1; 366/158.5; 366/176.1

(58) Field of Classification Search ..... 366/154.2, 366/155.1, 158.5, 176.1, 176.3, 176.4, 182.2, 366/340; 516/929–931
See application file for complete search history.

(56) References Cited

U.S. PATENT DOCUMENTS 4,000,086 A * 12/1976 Stoev et al. ..... 516/53
4,533,254 A * 8/1985 Cook et al. ..... 366/176.1
5,984,519 A * 11/1999 Onodera et al. ..... 366/340

* cited by examiner

*Primary Examiner*—David Sorkin
(74) *Attorney, Agent, or Firm*—Posz Law Group, PLC; R. Eugene Varndell, Jr.

(57) ABSTRACT

To provide an emulsion producing apparatus capable of producing an emulsion which is difficult to separate and is stabilized, and capable of achieving a reduction in cost and small-sized formation, there is provided an emulsion producing apparatus including mixing means for mixing liquids, a pressure rising pump for rising pressure of a mixture solution produced by the mixing means and emulsifying means 60 having a plurality of chambers 61A partitioned by partition walls 64 and formed with three small holes 64A at each of the partition walls for communicating the chambers 61A contiguous to the partition wall 64. The mixture solution pressurized to the emulsifying means 60 by the pressure rising pump, is injected from the small hole 64A of the partition wall 64 under high pressure and at high speed to thereby produce fluid friction. Accordingly, particles of the mixture solution can be made fine and a stable water emulsion fuel having excellent quality can be provided. Further, the emulsion producing apparatus is constituted by the mixing means and the emulsifying means 60 having a simple structure and therefore, downsizing of a total of the apparatus and a reduction in cost can be achieved.

9 Claims, 7 Drawing Sheets

EMULSION PRODUCING APPARATUS

BACKGROUND OF THE INVENTION

1. Field of the Invention

The present invention relates to an emulsion producing apparatus, in details, to an emulsion producing apparatus for producing an emulsion by mixing at least two kinds or more of liquids.

2. Description of the Related Art

Conventionally, it has been known to use a water emulsion fuel mixed with fuel and water to reduce poisonous substances such as nitrogen oxides (NOx) and black smoke in exhaust gas of an engine. In such a water emulsion fuel, a surfactant is used for improving mixing of fuel and water.

There are known apparatus of producing such a water emulsion fuel shown below.

<1> Apparatus of mixing fuel, water and surfactant by a high-speed mixer and supplying a mixture solution thereof to an engine.

<2> An apparatus of rotating fuel, water and surfactant and supplying a mixture solution mixed by the rotation to an engine.

Further, the following is proposed as an apparatus other than <1> and <2>.

<3> An apparatus having a cylindrical main body, a fluid accelerating nozzle an injection port of which is arranged in the cylindrical main body and a collision wall and an agitating rotor or stator arranged in the cylindrical main body. According to the producing apparatus, fuel, water and surfactant are mixed by a mixer, thereafter, the mixture solution is injected into the cylindrical main body by the liquid accelerating nozzle to thereby achieve to miniaturize particles of the mixture solution by making the mixture solution collide with the partition wall. Further, the mixture solution filled in the cylindrical main body is brought into a further uniformly mixed state by being agitated by the agitating rotor or a stator.

However, the following problems are posed in the apparatus of producing an emulsion fuel of <1> through <3> described above.

According to the producing apparatus of <1> and <2>, fuel, water and surfactant are mixed by mixing the mixture solution by the mixer or exerting rotational force to the liquids and therefore, the water emulsion fuel produced by the producing apparatus is not mixed sufficiently. Therefore, the water emulsion fuel is poor in stability and is not suitable for preservation, and fuel and water are liable to separate from each other in preservation. Further, when separated fuel and water are supplied to a fuel system of an engine, there is a concern that a deterioration such as rust is produced in the fuel system and adverse influence is effected on a function of the engine such as durability.

Meanwhile, according to the producing apparatus of <3>, time is taken in producing the water emulsion fuel and therefore, in order to continuously supply the produced water emulsion fuel to an engine, there is needed a storage tank for storing the produced water emulsion fuel, a total of the apparatus becomes large-scaled and therefore, there poses a problem in view of cost.

SUMMARY OF THE INVENTION

It is an object of the invention to provide an emulsion producing apparatus capable of producing an emulsion which is difficult to separate and is stabilized, and capable of achieving a reduction in cost and small-sized formation.

In order to achieve the above-described object, an emulsion producing apparatus according to the invention is constructed by the following constitution.

According to a first aspect of the invention, there is provided an emulsion producing apparatus which is an emulsion producing apparatus for producing an emulsion by mixing at least two kinds or more of liquids, the emulsion producing apparatus comprising mixing means for mixing the plurality of liquids substantially uniformly, a pressure rising pump for rising pressure of a mixture solution produced by the mixing means, and emulsifying means for bringing the mixture solution pressurized from the pressure rising pump into an emulsified state, wherein the emulsifying means includes a plurality of chambers into which the mixture solution flows, the plurality of chambers are partitioned by partition walls arranged among the respective chambers, and each of the partition walls is formed with at least one or more of small holes for communicating contiguous ones of the chambers interposing the partition walls.

According to the aspect of the invention, the plurality of liquids are mixed by the mixing means and the mixture solution is pressurized to the emulsifying means by the pressure rising pump. When the mixture solution flows into the chambers of the emulsifying means, the mixture solution is injected at high speed from the small holes of the partition wall and flows to the contiguous chamber. At this occasion, fluid friction is produced by the mixture solution injected at high speed from the small hole and the mixture solution filled in the contiguous chamber and therefore, the mixture solution can be brought into an emulsified state having a fine particle diameter.

Further, the plurality of liquids are mixed substantially uniformly by the mixing means, the mixture solution is supplied to the emulsifying means and therefore, the uniformly mixed emulsion can be produced.

Further, the emulsion producing apparatus according to the invention is constituted by the mixing means and the emulsifying means having a simple structure and therefore, a total of the apparatus can be downsized and a reduction in cost can be achieved.

According to a second aspect of the invention, there is provided the emulsion producing apparatus according to the first aspect wherein a diameter of an equivalent circle of the small hole of the partition wall falls in a range of 0.5 mm through 2 mm.

According to the aspect of the invention, the diameter of the equivalent circle of the small hole of the partition wall is made to fall in the range of 0.5 mm through 2 mm and accordingly, the mixture solution can be injected from the small hole under higher pressure and at high speed (for example, 40 through 50 m/s), the fluid friction between the mixture solution injected from the small hole at high speed and the mixture solution filled in the contiguous chamber can be increased and the mixture solution can be brought into the emulsified state in which the particle size is finer and which is difficult to separate.

Further, when the diameter of the equivalent circle of the small hole is made smaller than 0.5 mm, a resistance of the mixture solution in passing through the small hole becomes excessively large and therefore, the efficient mixing cannot be carried out. Meanwhile, when the diameter of the equivalent circle of the small hole is made larger than 2 mm, the produced fluid friction is small and therefore, there is a possibility that the mixture solution cannot be brought into the sufficient emulsified state.

According to a third aspect of the invention, there is provided the emulsion producing apparatus according to the first or the second aspect wherein delivery pressure of the pressure rising pump falls in a range of 5 MPa through 15 MPa.

According to the aspect of the invention, the delivery pressure of the pressure rising pump is made to fall in a range of 5 MPa through 15 MPa and therefore, operation and effect substantially similar to the second aspect of the invention can be expected.

That is, the mixture solution can be injected from the small hole under high pressure at high speed, the fluid friction can further be increased and the mixture solution can be brought into the emulsified state in which the particle size is finer and which is difficult to separate.

Further, when the delivery pressure of the pressure rising pump is made smaller than 5 MPa, the injecting speed of the mixture solution is reduced and the fluid friction is reduced and therefore, there is a possibility that particles of the mixture solution cannot be made fine sufficiently. Meanwhile, when the delivery pressure of the pressure rising pump is made larger than 15 MPa, the injecting speed of the mixture solution from the small hole becomes excessively large, the resistance of the mixture solution in passing through the small hole is increased and accordingly, the efficient mixing cannot be carried out.

According to a fourth aspect of the invention, there is provided the emulsion producing apparatus according to any one of the first through the third aspects wherein the mixing means mixes the plurality of liquids and a surfactant substantially uniformly.

According to the aspect of the invention, there is used the surfactant for reducing the surface tension of the liquid and therefore, the emulsion which is difficult to separate and is stabilized can be produced.

According to a fifth aspect of the invention, there is provided the emulsion producing apparatus according to any one of the first through the fourth aspects wherein the pressure rising pump is driven by an electric motor a rotational speed of which can be changed.

According to the aspect of the invention, the pressure rising pump is driven by the electric motor capable of changing the rotational speed and therefore, by arbitrarily setting the rotational speed of the electric motor, a delivery flow rate of the pressure rising pump can easily be adjusted and the speed and the pressure of the mixture solution injected from the small hole of the partition wall can easily be adjusted.

According to a sixth aspect of the invention, there is provided the emulsion producing apparatus according to any one of the first through the fourth aspects wherein the pressure rising pump is driven by an engine utilizing the mixture solution brought into the emulsified state by the emulsifying means as a fuel.

According to the aspect of the invention, for example, the pressure rising pump is driven by taking out drive force from a crankshaft or a cam shaft of the engine and therefore, a separate motor for driving the pressure rising pump is dispensed with, a number of parts can be reduced and a reduction in cost and space saving can be achieved.

According to a seventh aspect of the invention, there is provided the emulsion producing apparatus according to any one of the first through the sixth aspects wherein the pressure rising pump is of a variable delivery type.

According to the invention, the pump of the variable delivery type is used as the pressure rising pump and therefore, the delivery pressure of the pressure rising pump can freely be set and the speed and the pressure of the mixture solution injected from the small hole of the partition wall can simply be adjusted.

According to an eighth aspect of the invention, there is provided the emulsion producing apparatus according to any one of the first through the seventh aspects wherein a pre-pressurizing pump for pressurizing the mixture solution produced by the mixing means and sending it to the pressure rising pump is provided on an upstream side of the pressure rising pump.

According to the aspect of the invention, by the pre-pressurizing pump, the fluid pressure of mixture solution on an inlet side of the pressure rising pump can be increased and therefore, cavitation at the inlet of the pressure rising pump can be prevented.

According to a ninth aspect of the invention, there is provided the emulsion producing apparatus according to any one of the first through the eighth aspects wherein the emulsifying means includes a cylindrical main body, inside of the main body is aligned with spacers for maintaining constant intervals between the partition walls and/or an interval between the partition wall and one end of the main body, the spacers are aligned alternately along with the partition walls along a longitudinal direction of the main body, and the partition walls and the spacers are urged in one direction along the longitudinal direction of the main body to press to the main body by a spring arranged in the main body.

According to the aspect of the invention, the partition walls and the spacers are alternately aligned in the cylindrical main body, the partition walls and the spacers are urged to an end portion of the main body by the spring and therefore, an interval between contiguous ones of the partition walls can be maintained constant and the plurality of chambers can easily be formed in the main body.

Further, by only inserting alternately the partition walls and the spacers in the cylindrical main body and urging the partition walls and the spacers by the spring, the partition walls can be positioned and fixed and therefore, assembling operation of the emulsifying means can be facilitated.

According to a tenth aspect of the invention, there is provided the emulsion producing apparatus according to any one of the first through the ninth aspects wherein the plurality of liquids are two kinds of liquids of water and the fuel.

According to the aspect of the invention, the water emulsion fuel can be produced and when the water emulsion fuel is utilized in the engine, NOx or graphite in exhaust gas can be reduced.

DETAILED DESCRIPTION OF THE PREFERRED EMBODIMENTS

An explanation will be given of an embodiment of the invention in reference to the drawings as follows.

Figure 1:
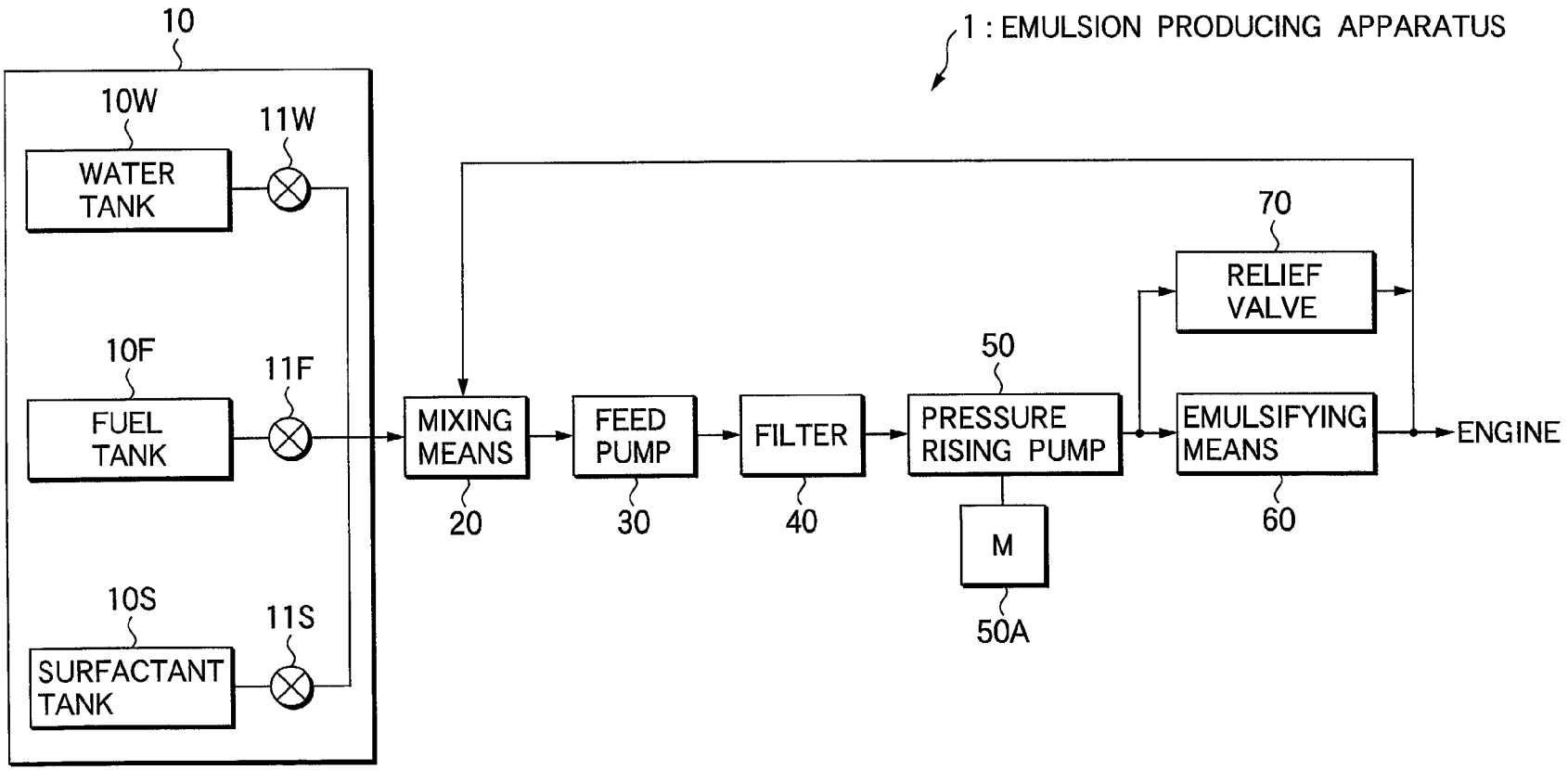
FIG. 1 is a block diagram showing an outline of an emulsion producing apparatus according to an embodiment of the invention.

FIG. 1 shows an emulsion producing apparatus 1 according to an embodiment of the invention.

The emulsion producing apparatus 1 produces a water emulsion fuel by mixing a plurality of liquids, for example, water, fuel and surfactant into an emulsified state and according to the embodiment, the water emulsion fuel is supplied to a fuel system of an engine.

The emulsion producing apparatus 1 is provided with a liquid supplying apparatus 10, mixing means 20, a feed pump 30 as a pre-pressurizing pump, a filter 40, a pressure rising pump 50, emulsifying means 60 and a relief valve 70.

The liquid supplying apparatus 10 is provided with a water tank 10W, a fuel tank 10F and a surfactant tank 10S respectively contained with water, fuel and surfactant. Flow control valves 11W, 11F and 11S for controlling flow rates are provided at outlets of the respective tanks 10W, 10F and 10S.

The mixing means 20 is arranged on downstream sides of the flow rate control valves 11W, 11F and 11S and fluids from the respective tanks 10W, 10F and 10S pass through the respective flow control valves 11W, 11F and 11S, thereafter join and flow to the mixing means 20.

Figure 2:
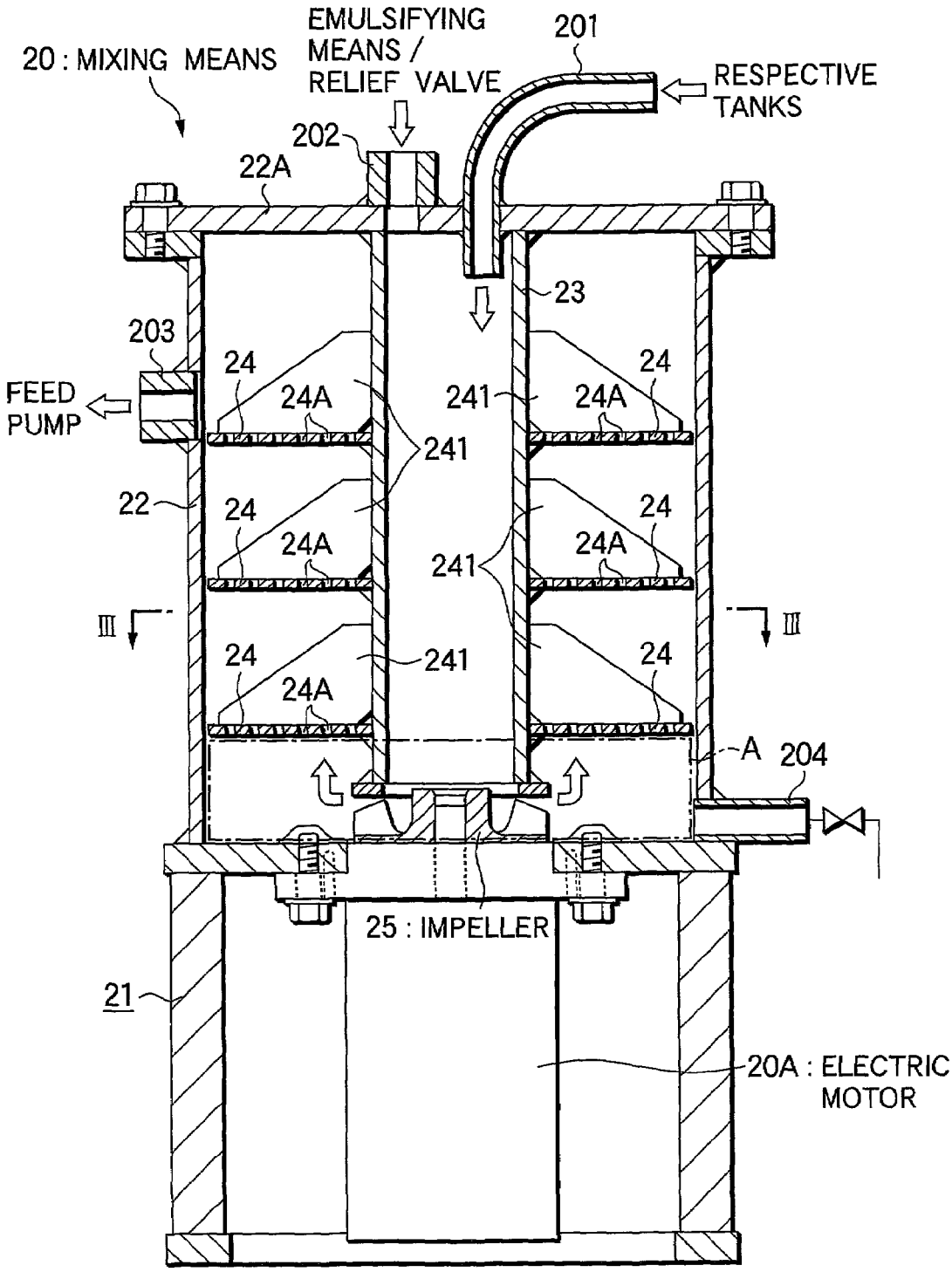
FIG. 2 is a vertical sectional view showing mixing means in the embodiment.
Figure 3:
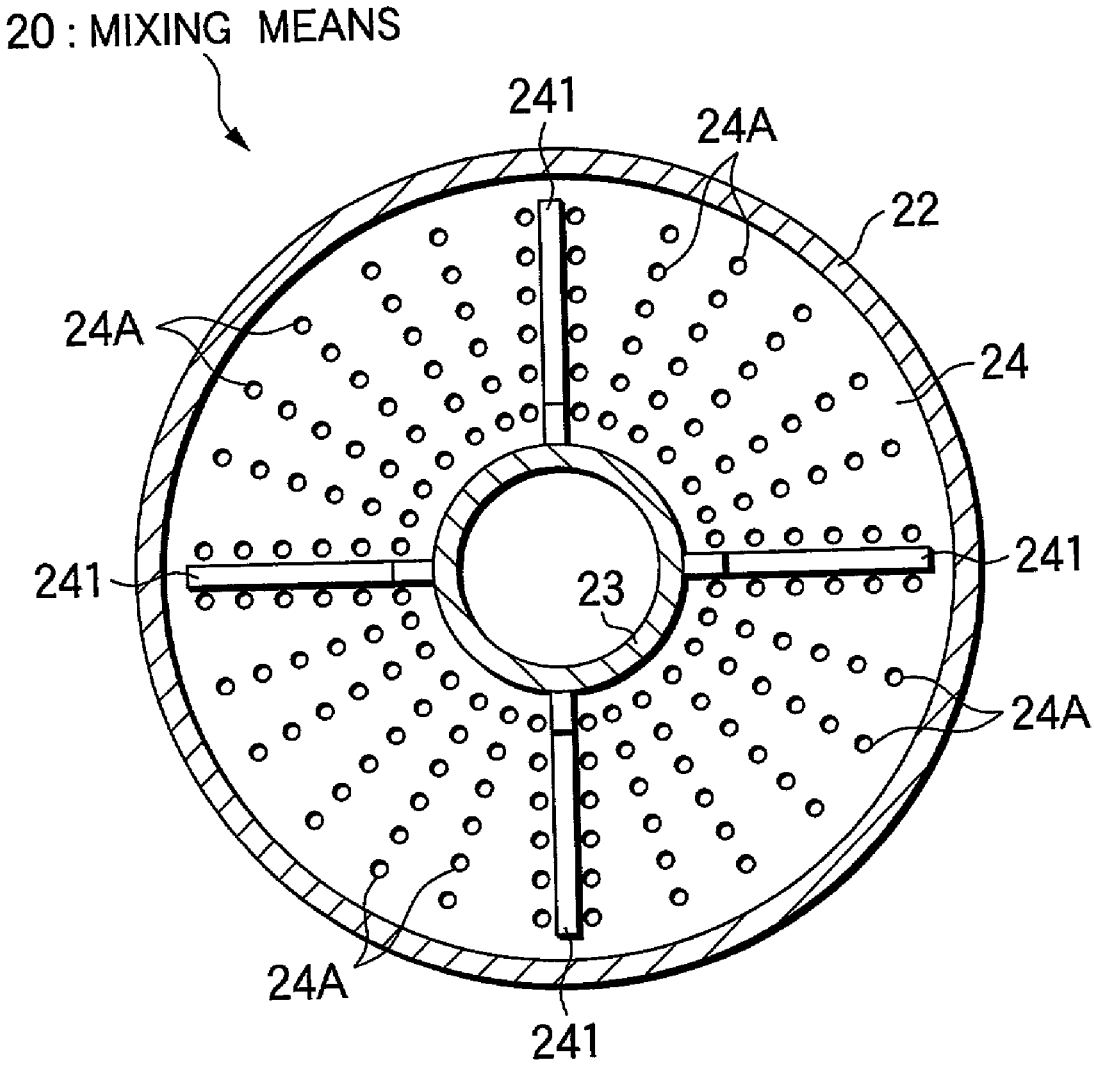
FIG. 3 is a sectional view taken along a line III—III of FIG. 2.

As shown by FIG. 2 and FIG. 3, the mixing means 20 is provided with a base 21 contained with an electric motor 20A and above the base 21, there is erected a cylindrical main body 22 an upper end opening of which is closed by a lid portion 22A and a lower end opening of which is closed by an upper face of the base 21. In the central portion of the main body 22, at a lower portion of the lid portion 22A, there is provided a cylindrical member 23 having a diameter smaller than that of the main body 22 to project to a lower side and an upper end of the cylindrical member 23 is fixed to a lower face of the lid portion 22A and a lower end thereof is opened to the lower side at a vicinity of the upper face of the base 21.

At an outer peripheral face of the cylindrical member 23, there are provided a plurality of sheets of circular disk members 24 having a diameter substantially the same as an inner diameter of the main body 22 in a longitudinal direction (up and down direction) of the cylindrical member 23, and the circular disk members 24 each is formed with a number of small holes 24A. Such a circular disk member 24 may be constituted by using, for example, punching metal. Further, according to each of the circular disk members 24, strength of attaching to the cylindrical member 23 is reinforced by four sheets of reinforcing members 241 each having a side face substantially in a triangular shape (FIG. 2) arranged in a cross-like shape (FIG. 3) at an upper portion of the circular disk member 24.

At a vicinity of the opening of the lower end of the cylindrical member 23, there is arranged an impeller 25 having a rotating shaft on an axis line substantially the same as an axis line of the cylindrical member 23, and the impeller 25 is rotated by the electric motor 20A at inside of the base 21, mentioned above.

The main body 22 of the mixing means 20 is provided with two inlets 201 and 202 and two outlets 203 and 204.

Both of the inlets 201 and 202 are formed substantially at center of the lid portion 22A for respectively communicating an outer side of the main body 22 and an inner portion of the cylindrical member 23.

In the inlets 201 and 202, the first inlet 201 is an opening for introducing water, fuel and surfactant from the respective tanks 10W, 1OF and 10S into the cylindrical member 23 and the second inlet 202 is an opening for introducing a liquid which has passed through the emulsifying means 60 or the relief valve 70 arranged downstream from the mixing means 20 into the cylindrical member 23 again.

Both of the outlets 203 and 204 are formed at portions of a side face of the main body 22 for respectively communicating inside and outside of the main body 22.

In the outlets 203 and 204, the first outlet 203 is an opening for supplying a liquid in the main body 22 to the feed pump 30 and is disposed upward from the circular disk member 24 which is arranged on the uppermost side. The second outlet 204 is an opening for discharging the liquid in the main body 22 and is disposed at a vicinity of the upper face of the base 21. Further, the second outlet 204 is normally closed and when inside of the main body 22 is intended to be evacuated, by opening the second outlet 204, all of the liquid in the main body 22 can be discharged.

According to such a constitution of the mixing means 20, in a state in which the liquid is substantially filled in the main body 22, the liquid flowing from the respective inlets 201 and 202 into the cylindrical member 23, flows out from the opening of the lower end of the cylindrical member 23 to the outer side of the cylindrical member 23 by the rotating impeller 25. Here, there is formed space A (space A surrounded by on-dotted chain lines in FIG. 2) closed to some degree by a lower face of the circular disk member 24 arranged on the lowermost side, an inner peripheral face of the main body 22 and the upper face of the base 21 and therefore the liquid is agitated in the space A by the impeller 25 to thereby uniformly mix water, fuel and surfactant.

The agitated liquid is lifted by rotational force of the impeller 25 and passes through the small holes 24A of the respective circular disk members 24. Thereby, water, fuel and surfactant are mixed further uniformly.

Although the liquid agitated by the impeller 25 constitutes a swirl flow at the lower portion of the main body 22, the liquid is rectified while passing through the small holes 24A of the plurality of sheets of circular disk members 24 and therefore, at the upper portion of the main body 22, only an elevating flow is substantially constituted. Therefore, the rectified mixture solution can be outputted from the first outlet 203 disposed upward from the circular disk member 24 at the topmost stage. Further, the mixture solution is supplied from the first outlet 203 to the feed pump 30.

Referring back to FIG. 1, the feed pump 30 is a pump for pressurizing the mixture solution produced by the mixing means 20 and supplying the mixture solution to the pressure rising pump 50 and according to the embodiment, there is used a feed pump of a fuel system in an engine utilizing the water emulsion fuel produced by the emulsion producing apparatus 1. The feed pump 30 is provided with drive force from a crankshaft or a cam shaft of the above-described engine.

Delivery pressure of the feed pump 30 may be set to a degree by which inlet pressure of the pressure rising pump 50 arranged downstream from the feed pump 30 does not become negative pressure (relative to the atmospheric pressure). Thereby, cavitation can be prevented at the inlet of the pressure rising pump 50.

The filter 40 is for removing dust and dirt in the liquid and according to the embodiment, there is used a fuel filter of the fuel system of the engine.

The pressure rising pump 50 is a variable delivery type plunger pump and there is pointed out, for example, an inclined shaft type axial type plunger pump, an inclined plate type axial type plunger pump or a rotary cylinder type radial type plunger pump. The pressure rising pump 50 is driven by an electric motor 50A rotational speed of which can be changed.

Here, the delivery pressure of the pressure rising pump 50 is set to 5 MPa through 15 MPa.

The emulsifying means 60 and the relief valve 70 are provided in parallel on the downstream side of the pressure rising pump 50. The relief valve 70 serves as a safety valve and when inlet pressure of the emulsifying means 60 exceeds set pressure of the relief valve 70, the relief valve 70 escapes the liquid to the mixing means 20.

Figure 4:
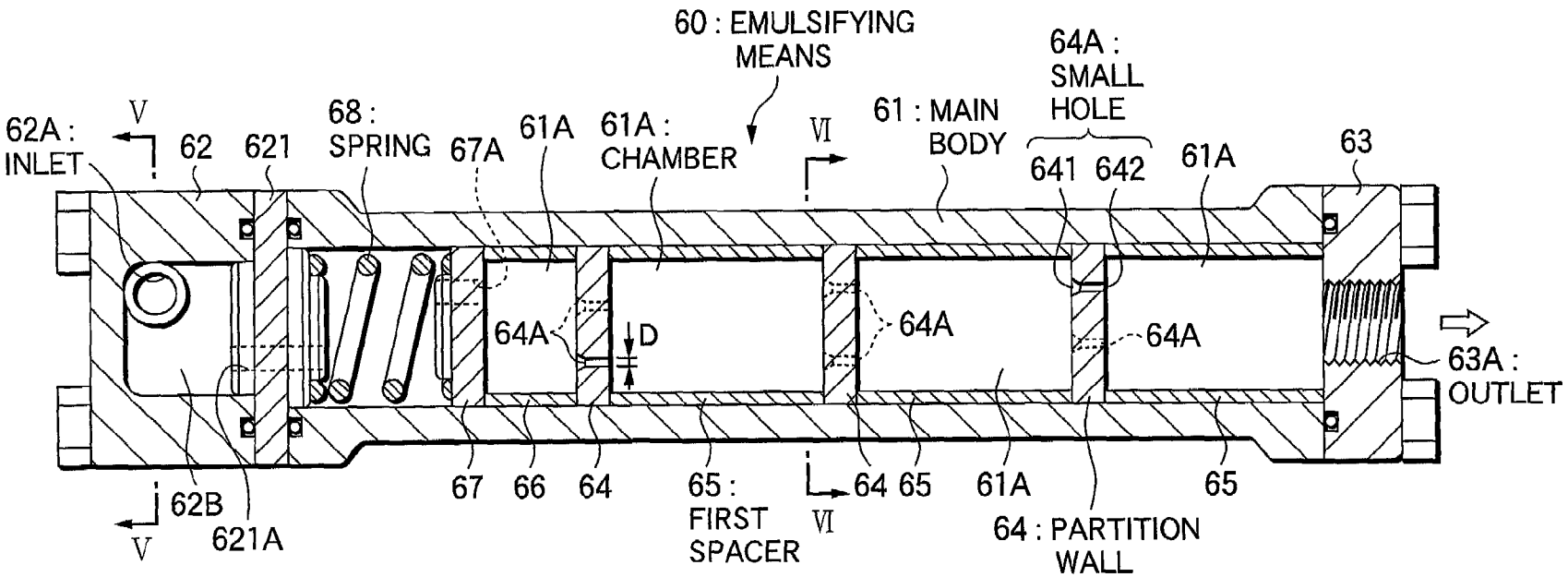
FIG. 4 is a vertical sectional view showing emulsifying means in the embodiment.
Figure 5:
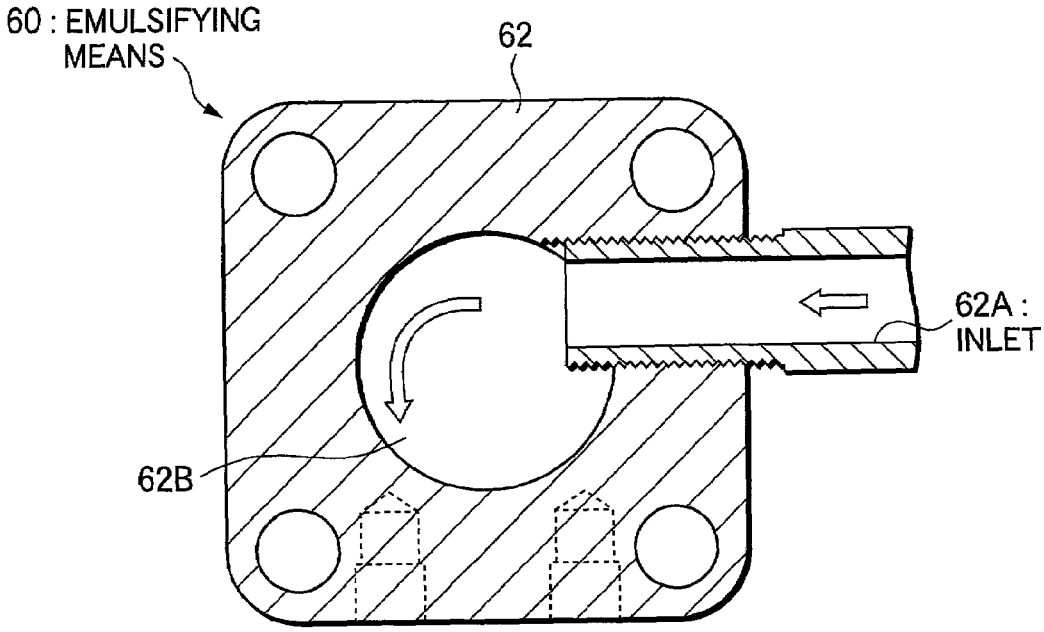
FIG. 5 is a sectional view taken along a line V—V of FIG. 4.
Figure 6:
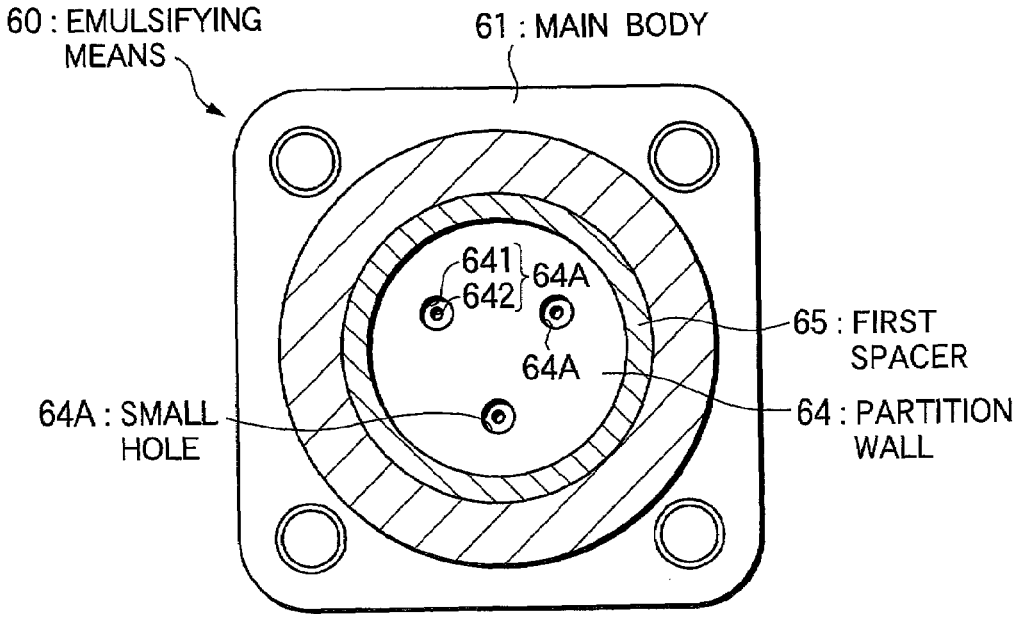
FIG. 6 is a sectional view taken along a line VI—VI of FIG. 4.

As shown by FIG. 4 through FIG. 6, the emulsifying means 60 is provided with a cylindrical main body 61, a left side lid portion 62 is attached to an opening of a left end of the main body 61 via an interposing member 621 and a right side lid portion 63 is attached to an opening of a right end thereof.

The left side lid portion 62 is formed in a cap-like shape and recessed space 62B communicates with inside of the cylinder of the main body 61 via a communication hole 621A formed at the interposing member 621. The left side lid portion 62 is formed with an inlet 62A in a direction substantially orthogonal to a longitudinal direction of the main body 61 (direction orthogonal to paper face of FIG. 4) for communicating inside and outside of the left side lid portion 62. The inlet 62A is formed in a circumferential direction at an upper portion of the recessed space 62B, that is, at a position offset from center of the recessed space 62B and when the liquid flows from the inlet 62A, there is constituted a swirl flow flowing along a wall face of the recessed space 62B (refer to FIG. 5).

Meanwhile, the right side lid portion 63 is formed with an outlet 63A along the longitudinal direction of the main body 61.

At inside of the main body 61, there are aligned a plurality of, according to the embodiment, three sheets of partition walls 64 in a circular disk shape along the longitudinal direction and between the partition walls 64 and between the partition wall 64 and the right side lid portion 63, there are respectively provided first spacers 65 as spacers of the invention in a shape of a thin-walled cylinder. Thereby, there are formed a plurality of chambers 61A partitioned by the partition walls 64 in the main body 61.

Further, at each of the partition walls 64, there are formed a plurality of small holes 64A for communicating contiguous ones of the chambers 61A and according to the embodiment, there are formed three of the small holes 64A spaced apart from each other by 120 degrees. Here, the respective small holes 64A are arranged such that positions of the small holes 64A of the contiguous partition walls 64 do not overlap when viewed from the longitudinal direction of the main body 61.

The small hole 64A is constituted by a diameter contracting hole portion 641 the diameter of which is contracted from the left side to the right side of FIG. 4 and a cylindrical hole portion 642 formed continuously to the right side (small diameter side) of the diameter contracting hole portion 641. A diameter D of an equivalent circle of the cylindrical hole portion 642 is set to 0.5 mm through 2 mm.

At inside of the main body 61, there is arranged a second spacer 66 in a shape of a thin-walled cylinder on the left side of the partition wall 64 arranged on the leftmost side in FIG. 4 and on the left side of the second spacer 66, there is arranged a spring receiving member 67 in a circular disk shape. Thereby, the chamber 61A is formed also between the partition wall 64 arranged on the leftmost side and the spring receiving member 67.

The spring receiving member 67 is formed with a communication hole 67A for communicating a space on the left side and a space on the right side interposing the spring receiving member 67. Both of axial directions of the communication hole 67A of the spring receiving member 67 and the communication hole 621A of the interposing member 621, mentioned above, are directed along the longitudinal direction of the main body 61 and are offset from each other.

A spring 68 is arranged between the spring receiving member 67 and the interposing member 621. The interposing member 621 is fixed to the left side end portion of the main body 61 and therefore, the spring receiving member 67 is urged to the right side of FIG. 4 by the spring 68 and the partition walls 64 and the spacers 65 and 66 arranged on the right side of the spring receiving member 67 in the drawing, are also urged to the right side. Thereby, the partition walls 64, the spacers 65 and 66 and the spring receiving member 67, are pressed to the right side lid portion 63 fixed to the right side end portion of the main body 61 to thereby position the partition walls 64, the spacers 65 and 66 and the spring receiving member 67.

When an explanation is given here of an assembling order of the emulsifying means 60 constituted in this way, first, the right side lid portion 63 is attached to the main body 61 and thereafter, the partition walls 64, the spacers 65 and 66 and the spring receiving member 67 are arranged in the main body 61. Next, the spring 68 is inserted into the main body 61 and the interposing member 621 and the left side lid portion 62 are attached to the left side end portion of the main body 61 to thereby finish assembling the emulsifying means 60.

In this way, by using the spring 68 and the first spacer 65, positioning of the partition walls 64 is facilitated and assembling operation of the emulsifying means 60 is simplified.

According to such a constitution of the emulsifying means 60, in a state in which the liquid is substantially filled in the main body 61, the mixture solution pressurized by the pressure rising pump 50 and made to flow from the inlet 62A to the left side lid portion 62, constitutes a swirl flow and is further mixed by passing through the communication hole 621A of the interposing member 621 and the communication hole 67A of the spring receiving member 67 which are offset, in this order.

Further, the mixture solution mixed in this way, passes through the small holes 64A of the respective partition walls 64 and flows from the chamber 61A on the left side to the chamber 61A on the right side interposing the partition wall 64. Here, the diameter of the equivalent circle of the cylindrical hole portion 642 of the small hole 64A is set to 0.5 mm through 2 mm, the delivery pressure of the pressure rising pump 50 is set to 5 MPa through 15 MPa and accordingly, the mixture solution is injected from the small holes 64A of the partition wall 64 to the chamber 61A on the right side at high speed and under high pressure. At this occasion, fluid friction is produced between the mixture solution injected from the small holes 64A of the partition wall 64 and the mixture solution filled in the chamber 61A on the right side and therefore, particles of the mixture solution are split by the friction and the water emulsion fuel having a small particle diameter is provided.

Next, an explanation will be given of a relationship between the delivery pressure of the pressure rising pump 50 and the magnitude of the particle diameter of the water emulsion fuel in reference to a graph of FIG. 7.

Figure 7:
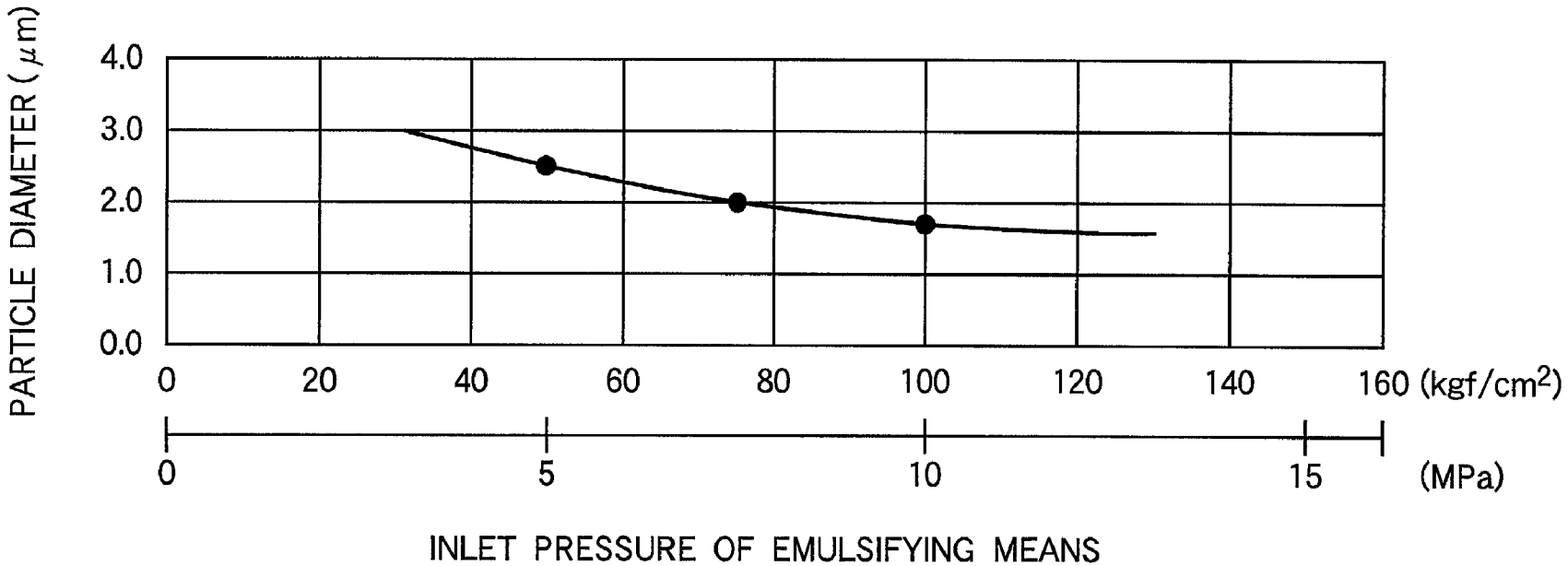
FIG. 7 is a graph showing a relationship between a magnitude of a particle diameter and a magnitude of inlet pressure of the emulsifying means according to the embodiment.

In the graph of FIG. 7, the ordinate designates a magnitude of the particle size of the water emulsion fuel and the abscissa designates the magnitude of the delivery pressure of the pressure rising pump 50, that is, the inlet pressure of the emulsifying means 60 and it is known that the higher the inlet pressure of the emulsifying means 60 the smaller the particle diameter of the water emulsion fuel.

The water emulsion fuel is liable to become nonuniform by separating fuel and water when the particle size is large and therefore, when the water emulsion fuel having the large particle diameter is used in an engine, there is caused a drawback that the performance of the engine is not stabilized. Therefore, it is preferable to reduce the particle diameter of the water emulsion fuel.

In the case of the system of producing the mixture solution by the emulsifying means 60 and thereafter supplying the mixture solution continuously to an engine (for example, fuel injection pump of fuel system) as in the emulsion producing apparatus 1 according to the embodiment, a time period from production to use of the water emulsion fuel is not long and therefore, the magnitude of the mean particle diameter may be equal to or smaller than about 2.5 μm and it is known from the graph that in order to produce the water emulsion fuel having the particle diameter equal to or smaller than about 2.5 μm, the inlet pressure of the emulsifying means 60, that is, the lower limit of the delivery pressure of the pressure rising pump 50 may be equal to or larger than 5 MPa.

Meanwhile, in consideration of durability and energy consumption of the pressure rising pump 50, it is preferable that the upper limit is made to be equal to or smaller than 15 MPa.

That is, it is preferable to set the inlet pressure of the emulsifying means 60 (delivery pressure of pressure rising pump 50) to 5 MPa through 15 MPa (50 kgf/cm$^2$ through 150 kgf/cm$^2$).

Further, the water emulsion fuel having the mean particle diameter equal to or smaller than 2 μm, is difficult to promote separation and is stabilized over a long period of time and therefore, the water emulsion fuel is optimum as fuel of an engine repeating stop and operation and in order to produce the water emulsion fuel having the particle diameter equal to or smaller than 2 μm, it is preferable to set the lower limit of the inlet pressure of the emulsifying means 60 to be equal to or higher than about 7.5 MPa.

Further, as is known also from the graph, even when the inlet pressure of the emulsifying means 60 is set to be larger than 12 MPa, an effect of reducing the particle diameter is small. Thereby, it is further preferable to set the upper limit of the inlet pressure of the emulsifying means 60 to be equal to or smaller than 12 MPa for achieving energy conservation.

As described above, the magnitude of the inlet pressure of the emulsifying means 60, that is, the magnitude of the delivery pressure of the pressure rising pump 50 may pertinently be set in the range of 5 MPa through 15 MPa depending on the magnitude of the particle diameter of the water emulsion fuel intended to be produced. The magnitude of the delivery pressure of the pressure rising pump 50 can arbitrary be set by changing the rotational speed of the electric motor 50A for driving the pressure rising pump 50 and when the pressure rising pump 50 is, for example, an inclined plate type axial type plunger pump, by changing an angle of the inclined plate to thereby change the delivery volume.

Although in the above-described, an explanation has been given of the relationship between the delivery pressure of the pressure rising pump 50 and the magnitude of the particle diameter of the water emulsion fuel, the magnitude of the particle diameter of the produced water emulsion fuel is changed also by the magnitude of the small hole 64*a* of the partition wall 64 in the emulsifying means 60.

According to the embodiment, by setting the diameter D of the equivalent circle of the small hole 64A to 0.5 mm through 2 mm, the mixture solution can be injected from the small hole 64A under high pressure and at high speed (for example, 40 through 50 m/s) to thereby increase fluid friction produced by the mixture solution injected from the small hole 64A and the mixture solution filled in the chamber 61A on the injected side. Thereby, there can be produced the mixture solution in the emulsified state which is difficult to separate and in which the particle diameter is made further fine.

Further, when the diameter of the equivalent circle of the small hole 64A is made smaller than 0.5 mm, resistance of the mixture solution in passing through the small hole 64A becomes excessively large and therefore, efficient mixing cannot be carried out. Meanwhile, when the diameter of the equivalent circle of the small hole 64A is made to be larger than 2 mm, the produced fluid friction is small and therefore, there is a possibility that the mixture solution cannot be brought into a sufficiently emulsified state.

Next, an explanation will be given of operation of the embodiment.

First, pertinent amounts of water, fuel and surfactant are supplied from the liquid supplying apparatus 10 to the mixing means 20 by the flow control valves 11W, 11F and 11S. The mixture solution mixed substantially uniformly by the impeller 25 in the mixing means 20, is pressurized by the feed pump 30, passes through the filter 40 and is supplied to the pressure rising pump 50. The mixture solution pressurized to the emulsifying means 60 by the pressure rising pump 50, is brought into a stabilized emulsified state by being injected from the small holes 64A of the partition walls 64 under high pressure and at high speed as mentioned above. That is, there is produced the water emulsion fuel having excellent quality. The water emulsion fuel produced in this way is supplied to a fuel injection pump of a fuel system of an engine, not illustrated.

Further, when there causes a malfunction such as clogging the small hole 64A of the emulsifying means 60, the inlet pressure of the emulsifying means 60 becomes larger than normal and therefore, the relief valve 70 is opened and the mixture solution pressurized by the pressure rising pump 50 is escaped to the mixing means 20.

Here, there may be constructed a constitution in which an amount of supplying the water emulsion fuel supplied from the emulsion producing apparatus 1 to the engine, is set to be larger than an amount of using the water emulsion fuel used in the engine and as shown by FIG. 1, the water emulsion fuel produced excessively is returned to the mixing means 20 again. Thereby, the mixing means 20 always contain the water emulsion fuel having an amount to some degree and therefore, also in starting the emulsion producing apparatus 1, the water emulsion fuel having stabilized excellent quality can be supplied to the engine.

According to the above-described embodiment, the following effects are achieved.

(1) The fluid friction is produced between the mixture solution injected from the small hole 64A of the partition wall 64 under high pressure and at high speed and the mixture solution filled in the chamber 61A on the injected side in the emulsifying means 60 and therefore, the mixture solution can be brought into an emulsified state having a fine particle diameter and the water emulsion fuel having the stabilized excellent quality can be provided.

Further, a plurality of liquids are mixed substantially uniformly by the mixing means 20 and the mixture solution is supplied to the emulsifying means 60 and therefore, the uniformly mixed water emulsion fuel can be produced.

Further, the emulsion producing apparatus 1 is constituted by the mixing means 20 and the emulsifying means 60 having the simple structure and therefore, a total of the apparatus can be downsized and a reduction in cost can be achieved.

(2) In the emulsifying means 60, the diameter of the equivalent circle of the small hole 64A of the partition wall 64 is set to 0.5 mm through 2 mm and accordingly, the mixture solution can be injected from the small hole 64A under higher pressure and at higher speed (for example, 40 through 50 m/s) and the fluid friction can further be increased. Thereby, the mixture solution can be brought into an emulsified state which is difficult to separate by further reducing the particle diameter.

(3) The delivery pressure of the pressure rising pump 50 is set to 5 MPa through 15 MPa and therefore, the mixture solution can be injected from the small hole 64A of the emulsifying means 60 under high pressure and at high speed and the mixture solution can be brought into an emulsified state which is difficult to separate and in which the particle diameter is made finer.

(4) A surfactant for reducing surface tension of water and fuel is used and therefore, there can be produced the stabilized water emulsion fuel which is difficult to separate.

(5) The pressure rising pump 50 is driven by the electric motor 50A the rotational speed of which can be changed and therefore, by arbitrarily setting the rotational speed of the electric motor 50A, the delivery flow rate of the pressure rising pump 50 can easily be controlled and speed and pressure of the mixture solution injected from the small hole 64A in the emulsifying means 60 can easily be controlled.

(6) The variable delivery type pump is used as the pressure rising pump 50 and therefore, the delivery pressure of the pressure rising pump 50 can freely be set, and speed and pressure of the mixture solution injected from the small hole 64A of the emulsifying means 60 can simply be controlled.

(7) The feed pump 30 is provided on the upstream side of the pressure rising pump 50 and therefore, the fluid pressure of the mixture solution in the inlet side of the pressure rising 50 can be increased and cavitation at the inlet of the pressure rising pump 50 can be prevented.

(8) In the emulsifying means 60, the partition walls 64 and the spacers 65 are alternately aligned in the main body 61, the partition walls 64 and the first spacers 65 are urged to the right side lid portion 63 by the spring 68 and therefore, intervals between contiguous ones of the partition walls 64 can be maintained constant and a plurality of chambers can easily be formed in the main body 61.

Further, by only inserting the partition walls 64 and the first spacers 65 alternately in the main body 61 and urging the partition walls 64 and the first spacers 65 by the spring 68, the partition walls 64 can be positioned and fixed and therefore, the assembling operation of the emulsifying means 60 can easily be carried out.

(9) Since the water emulsion fuel is produced by the emulsion producing apparatus 1 and supplied to the engine and therefore, NOx or graphite in the exhaust gas of the engine can be reduced.

Further, the invention is not limited to the embodiment but modifications and improvements in a range capable of achieving the object of the invention are included in the invention.

For example, although according to the embodiment, in the emulsifying means 60, the partition walls 64 are positioned and fixed in the main body 61 by using the spacers 65 and 66 and the spring 68, the partition walls 54 may be positioned and fixed in the main body 61 by adhering means such as welding, and such a case is included in the invention.

Although according to the embodiment, the feed pump 30 is provided, the feed pump 30 may not particularly be provided. However, it is preferable to provide the feed pump 30 in order to prevent cavitation at the inlet of the pressure rising pump 50.

Further, although as the feed pump 30, a feed pump of an engine utilizing the water emulsion fuel produced by the emulsion producing apparatus 1 is used, a pump separate from the feed pump of the engine may be used.

Although according to the embodiment, the pressure rising pump 50 is a plunger pump of a variable delivery type, the pressure rising pump 50 may not be a plunger pump, further, may be a pump of a constant delivery type.

Further, although according to the embodiment, the pressure rising pump 50 is driven by the electric motor 50A, for example, the pressure rising pump 50 may be driven by taking out drive force from a crankshaft or a cam shaft of an engine. In such a case, the separate electric motor 50A for driving the pressure rising pump 50 is dispensed with and therefore, a number of parts can be reduced and a reduction in cost and space saving can be achieved.

Figure 8:
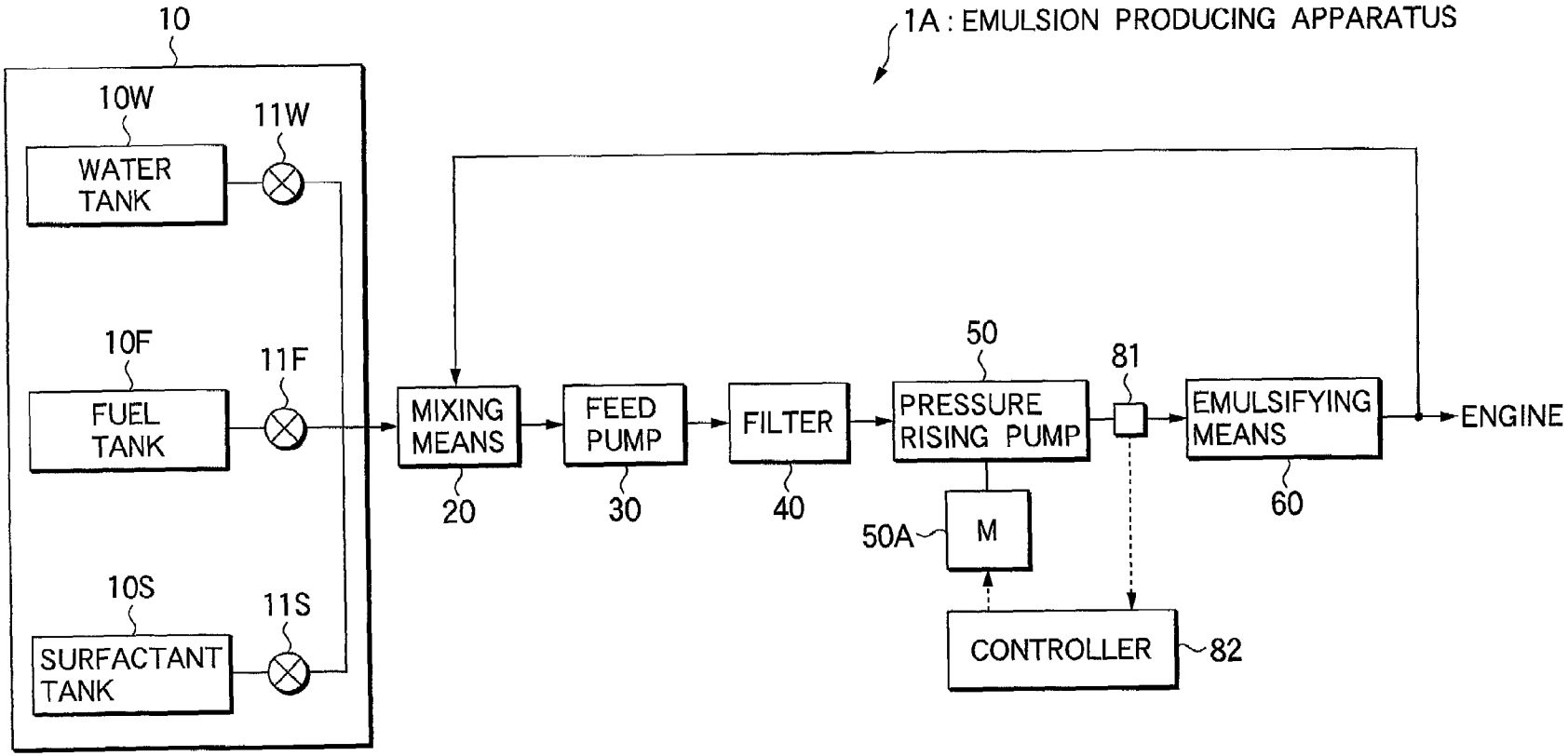
FIG. 8 is a block diagram showing a modified example of the invention.

Although according to the embodiment, the relief valve 70 is provided as the safety valve of the emulsion producing apparatus 1, for example, there may be constituted an emulsion producing apparatus 1A as shown by FIG. 8.

In FIG. 8, the emulsion producing apparatus 1A is provided with a controller 82 for controlling the rotational number of the electric motor 50A of the pressure rising pump 50. The controller 82 changes the rotational number of the electric motor 50A in accordance with an output signal from a pressure sensor 81 provided at a flow path between the pressure rising pump 50 and the emulsifying means 60, that is, in accordance with the inlet pressure of the emulsifying means 60.

According to the emulsion producing apparatus 1A, when there is a malfunction of clogging the small hole 64A of the emulsifying means 60, the inlet pressure of the emulsifying means 60 becomes larger than normal and therefore, the rotational number of the electric motor 50A is reduced based on the output signal from the pressure sensor 81 and the delivery volume of the pressure rising pump 50 is reduced. Thereby, the inlet pressure of the emulsifying means 60 can always be maintained constant and unreasonable load can be prevented from being applied to the emulsifying means 60.

Although according to the embodiment, the water emulsion fuel is produced by mixing water, fuel and surfactant, the surfactant is not necessarily needed and the case of producing the water emulsion fuel by mixing only water and fuel without using surfactant is also included in the invention.

Although according to the embodiment, the delivery pressure of the pressure rising pump 50 is set to 5 MPa through 15 MPa, the delivery pressure may be set to a value outside of the numerical value range and in such a case, the liquid can be injected from the small hole 64A under high pressure and at high speed by changing the magnitude of the diameter D of the equivalent circle of the small hole 64A of the partition wall 64 in the emulsifying means 60 by pertinently corresponding to the value of the delivery pressure of the pressure rising pump 50.

Although according to the embodiment, in the emulsifying means 60, the diameter of the equivalent circle of the small hole 64A of the partition wall 64 is set to 0.5 mm through 2 mm, the diameter may be set to a value outside of the numerical value range and in such a case, the liquid can be injected from the small hole 64A under high pressure and at high speed by changing the magnitude of the delivery pressure of the pressure rising 50 by pertinently corresponding to the value of the diameter D of the equivalent circle of the small hole 64A.

Although according to the embodiment, the emulsion producing apparatus 1 supplies the produced water emulsion fuel continuously to the engine, for example, the water emulsion fuel may be stored to a storage tank and such a case is also included in the invention.

Although according to the embodiment, the water emulsion fuel is produced by mixing water, fuel and surfactant by the emulsion producing apparatus 1, the emulsion producing apparatus may be used in producing emulsions and mixing respective liquids in the field of, for example, agricultural chemicals, cosmetics, food or medical treatment.

According to the emulsion producing apparatus of the invention, there is achieved an effect of capable of producing a stabilized emulsion which is difficult to separate and achieving a reduction in cost and downsizing.

What is claimed is:

1. An emulsion producing apparatus for producing an emulsion by mixing at least two kinds or more of liquids, said emulsion producing apparatus comprising:

mixing means for mixing the plurality of liquids substantially uniformly;

a pressure rising pump for rising pressure of a mixture solution produced by the mixing means; and emulsifying means for bringing the mixture solution pressurized from the pressure rising pump into an emulsified state, the emulsifying means including a cylindrical main body;

wherein the emulsifying means includes a plurality of chambers into which the mixture solution flows;

wherein the plurality of chambers are partitioned by partition walls arranged among the respective chambers;

wherein each of the partition walls is formed with at least one or more of small holes for communicating contiguous ones of the chambers interposing the partition walls;

wherein inside of the main body is aligned with spacers for maintaining constant intervals between the partition walls and/or an interval between the partition wall and one end of the main body;

wherein the spacers are aligned alternately along with the partition walls along a longitudinal direction of the main body; and wherein the partition walls and the spacers are urged in one direction along the longitudinal direction of the main body to press to the main body by a spring arranged in the main body.

2. The emulsion producing apparatus according to claim 1, wherein delivery pressure of the pressure rising pump provided at an inlet of the emulsifying means falls in a range of 5 MPa through 15 MPa;

wherein the plurality of chambers are ranged in series; and wherein a diameter of an equivalent circle of the small hole of the partition wall falls in a range of 0.5 mm through 2 mm.

3. The emulsion producing apparatus according to claim 1, wherein the mixing means includes a circular disk member for mixing the plurality of liquids and a surfactant substantially uniformly.

4. The emulsion producing apparatus according to claim 1, wherein the mixing means includes an impeller for mixing the plurality of liquids and a surfactant substantially uniformly.

5. The emulsion producing apparatus according to claim 1, wherein the pressure rising pump is driven by an electric motor whose rotational speed can be changed.

6. The emulsion producing apparatus according to claim 1, wherein the pressure rising pump is driven by an engine utilizing the mixture solution brought into the emulsified state by the emulsifying means as a fuel.

7. The emulsion producing apparatus according to claim 1, wherein the pressure rising pump is of a variable delivery type.

8. The emulsion producing apparatus according to claim 1, wherein a pre-pressurizing pump for pressurizing the mixture solution produced by the mixing means and sending it to the pressure rising pump is provided on an upstream side of the pressure rising pump.

9. The emulsion producing apparatus according to claim 1, wherein the mixing means includes a first inlet for introducing water, fuel, and surfactant into the mixing means, and a second inlet for introducing emulsifying liquid from the emulsifying means into the mixing means.

* * * * *